US008707635B1

(12) United States Patent
Calini

(10) Patent No.: US 8,707,635 B1
(45) **Date of Patent: *Apr. 29, 2014**

(54) MULTI-HEEL CONNECTOR

(71) Applicant: Anthony J. Calini, Guilford, CT (US)

(72) Inventor: Anthony J. Calini, Guilford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/089,181

(22) Filed: Nov. 25, 2013

Related U.S. Application Data

(63) Continuation of application No. 13/971,032, filed on Aug. 20, 2013, now Pat. No. 8,615,935.

(51) Int. Cl.
*E04B 7/04* (2006.01)
*E04B 1/38* (2006.01)
*E04B 1/26* (2006.01)

(52) U.S. Cl.
CPC ..... *E04B 1/2608* (2013.01); *E04B 1/2604* (2013.01); *E04B 1/2612* (2013.01); *E04B 7/045* (2013.01)
USPC ..... 52/92.2; 52/92.3; 52/93.2; 52/289; 52/712

(58) Field of Classification Search
CPC ..... E04B 7/045; E04B 1/2604; E04B 1/2608; E04B 1/2612
USPC ..... 52/92.2, 93.1, 289, 702, 712, 715, 52/655.1, 93.2, 92.3; 403/232.1, DIG. 15
See application file for complete search history.

(56) References Cited

U.S. PATENT DOCUMENTS

| | | | | |
|---|---|---|---|---|
| 797,474 | A * | 8/1905 | Walker | 52/63 |
| 2,354,801 | A * | 8/1944 | De Huff | 403/389 |
| 3,091,822 | A * | 6/1963 | Fiekers et al. | 403/394 |
| 3,256,030 | A * | 6/1966 | Banse | 403/400 |
| 3,967,908 | A | 7/1976 | Snow et al. | |
| 4,410,294 | A * | 10/1983 | Gilb et al. | 403/27 |
| 4,669,235 | A | 6/1987 | Reinen | |
| 4,976,085 | A | 12/1990 | Krueger | |
| 5,109,646 | A * | 5/1992 | Colonias et al. | 52/712 |

(Continued)

FOREIGN PATENT DOCUMENTS

| | | | | |
|---|---|---|---|---|
| EP | 1672133 | A2 * | 6/2006 | |
| WO | WO 9740238 | A1 * | 10/1997 | |
| WO | WO 2008065437 | A1 * | 6/2008 | E04B 7/04 |

OTHER PUBLICATIONS

Simpson Strong-Tie Company, Inc., Wood Construction Connectors 2011-2012, C-2011, pp. 126, 181.

(Continued)

*Primary Examiner* — Robert Canfield
(74) *Attorney, Agent, or Firm* — Robert Curcio; DeLio, Peterson & Curcio, LLC

(57) ABSTRACT

A multi-heel connector for securing a rafter, a ceiling joist and blocking, and supporting building roof structural members in a single bracket connection to withstand enhanced load forces such as hurricane forces. The multi-heel connector combines a loop portion for securing a joist, a rafter contact surface adjacent the loop portion, having a slope which provides for a selected, predetermined roof pitch, mounting tabs for securing the multi-heel connector to a top wall plate, tabs to fasten blocking and a tie down for securing the multi-heel connector to exterior wall stud. The multi-heel connector is adaptable for accommodating a riser key to adjust the rafter contact surface pitch, and a joist spacer to accommodate a joist having a cross-section smaller than the multi-heel connector loop portion cross-section.

15 Claims, 9 Drawing Sheets

(56) References Cited

U.S. PATENT DOCUMENTS

| | | | | |
|---|---|---|---|---|
| 5,230,198 | A * | 7/1993 | Callies | 52/702 |
| 5,335,469 | A * | 8/1994 | Stuart | 52/655.1 |
| 5,561,949 | A * | 10/1996 | Knoth | 52/92.2 |
| 6,295,781 | B1 | 10/2001 | Thompson | |
| 6,837,019 | B2 | 1/2005 | Collie | |
| 6,922,967 | B2 * | 8/2005 | Collie | 52/656.9 |
| 6,931,813 | B2 * | 8/2005 | Collie | 52/713 |
| 7,316,098 | B1 * | 1/2008 | Sackett | 52/92.2 |
| 7,971,410 | B2 * | 7/2011 | Jerke | 52/702 |
| 2002/0124483 | A1 * | 9/2002 | Rosas | 52/92.2 |
| 2006/0150564 | A1 * | 7/2006 | Dufault | 52/702 |
| 2008/0244993 | A1 * | 10/2008 | Crumley | 52/92.2 |
| 2009/0090082 | A1 * | 4/2009 | Kawai et al. | 52/712 |
| 2011/0225924 | A1 * | 9/2011 | Carbonaro et al. | 52/698 |

OTHER PUBLICATIONS

United Steel Products Company, "Connect with Confidence," USP Professional Design Manual and Product Catalog, 2011, pp. 64, 135, 56th Edition.

* cited by examiner

MULTI-HEEL CONNECTOR

BACKGROUND OF THE INVENTION

1. Field of the Invention

The present invention relates to a connector for making a structural connection between a plurality of structural members joined at an angle. Specifically, the present invention relates to a multi-heel connector for securing a rafter, a ceiling joist, and blocking between rafters, and supporting wood walls in a single bracket connection. The design capacity of the multi-heel connector is sufficient to provide for superimposed vertical/horizontal/diagonal dead and live loads, including enhanced loads such as hurricane wind forces from contributing areas.

2. Description of Related Art

The connector of the present invention has particular utility with respect to light frame building construction that predominates the residential and light commercial construction market. Many different connectors are used in the art for joining structural members for building construction. These different connectors are designed to secure rafters and joists to the adjoining walls of a building structure. The connectors are provided with through-holes for fasteners that are driven through the connector and into the side faces of the structural members being connected.

In addition, the connectors for securing a rafter, ceiling joist, and supporting wood walls must now be designed for withstanding the upward and lateral loads developed by high winds, which differ by geographic location, and may include hurricane forces.

The prior art has provided numerous configured connectors to secure construction structural members to one another individually, particularly in the area of rafter-joist-wall attachments.

For example, in U.S. Pat. No. 3,967,908 issued to Snow, et al., on Jul. 6, 1976, titled "CROSS TIE SADDLE BRACKET," a weld fabricated steel saddle bracket is taught having an elongated angle member with a portion adapted to abut the side of the top wall plate of a building and another portion adapted to lie on the top of the top wall plate, with two right angle members welded to the top portion of an elongated angle member. This is used as a cross tie saddle bracket for roof trusses. The weld attachment is such that one side edge of the horizontal flat portion is in planar alignment with the vertical side of the elongated member, and the end thereof is substantially flush with the end of the elongated angle member. A ceiling joist is adapted to be received in the saddle. A roof rafter is also carried in the saddle formed by the top of the elongated angle member, and the parallel spaced apart vertical portions of the first and second angle members.

Absent from this design, however, is an angled base segment or connector portion for supporting a rafter without a birdsmouth cut, as well as the angled tabs for attaching the blocking, and vertical tie down tabs.

In U.S. Pat. No. 4,669,235 issued to Reinen on Jun. 2, 1987, titled "SPACING AND SUPPORT CONSTRUCTION MEMBER," a spacing and support construction member for wood frame construction is taught, providing precise positioning and support for cross members. The structure provides for an elongated center strip, nailing prongs, and multiple pairs of perpendicular projections at fixed locations along the center strip. The perpendicular projections are located on opposite sides of the center strip, and separated by a distance, which corresponds to the width of the cross member. A nailing tab extends outwards from the center strip, in the plane of the center strip. In a similar fashion to the '908 patent, absent from this design is an angled base segment or structure for supporting a rafter, as well as the angled tabs for attaching the blocking, and a vertical tie down tab.

In U.S. Pat. No. 4,976,085 issued to Krueger on Dec. 11, 1990, titled "CONSTRUCTION PLATE," a construction plate is taught that includes a central body with a plurality of opposed legs directed outwardly, and a plurality of flanges mounted to bend lines relative to the central body to permit securement of the construction stud. The elongated central body has extended orthogonal forward legs. A right flange plate is bendable along a bend line mounted to the right side edge of the central body. Similarly, a left flange plate is integrally formed to the left side edge of the central body. Bending the flanges permits the mounting of a vertical stud member to a roof truss and a top plate stud. Although this brace accommodates an angled truss, it does so by providing brace-support via vertically extending members; there are no angled portions of the bracket to provide support for the truss. This brace also does not have tab or connection for the blocking member. The connection of the '085 patent refers to a truss support. Trusses are inherent structural members unlike individual rafter/joist construction; thus, the brace of the '085 patent does not provide for lateral loads which are within the truss itself.

In U.S. Pat. No. 6,295,781 issued to Thompson on Oct. 2, 2001, titled "STUD, TOP PLATE, AND RAFTER TIE DOWN," a one piece metal connector is taught that ties the structural members of the roof and wall on a wood framed house. The rafter, side wall support and upper and lower top plate are all secured by the bracket. The plate tab is essentially comprised of several right angle bends that include extended legs with a plurality of nail holes to secure to the rafter, the side wall support, and the top plate. The bracket forms an anchor clip for securing the rafter and sidewall support, and is vertically symmetric such that by turning it upside down, it can be used on the opposite side of the rafter and sidewall support. However, the bracket does not provide a structure for holding the rafter at an angled position, eliminating the typical birdsmouth cut on the rafter, or an extension for performing a tie down capable of withstanding hurricane force winds. There is also no connection for a blocking member, and no provision for a lateral load between the rafter and joist.

In U.S. Pat. No. 6,837,019 issued to Collie on Jan. 4, 2005, titled "TORNADO AND HURRICANE ROOF TIE," an angled riser includes a bridge angled to correspond with a selected pitch for a rafter. This design still does not include an angled bracket for supporting the bottom portion and weight of a rafter. The riser portion does not include a bottom piece for varying the rafter at different pitches. The rafter is secured to the bracket by nail holes in the raised bracket portion. There is also no connection for a blocking member, and no provision for a lateral load between the rafter and joist.

The present invention overcomes the disadvantages of the prior art by accommodating conventional joint construction at the heel with a multi-heel connector that addresses and facilitates the unique angles of attachment while securing the connection against high dynamic loads, such as hurricane force winds.

Other advantages of the present invention include a reduction in time to fabricate each rafter in handling, measuring, and layout, and omitting birdsmouth cuts.

SUMMARY OF THE INVENTION

Bearing in mind the problems and deficiencies of the prior art, it is therefore an object of the present invention to provide a multi-heel connector capable of adjoining the structural components at a heel joint in a building, including a rafter, joist, top wall plate, blocking member, and wall stud, in a single connector.

It is another object of the present invention to provide a multi-heel connector that adjoins the structural components of a building at a heel joint in a manner that withstands hurricane forces acting on the building's roof system.

It is a further object of the present invention to provide a multi-heel connector that can provide an angled surface area integral with the joist loop connection for greater rafter support.

It is yet another object of the present invention to provide a multi-heel connector capable of accommodating different roof pitches and joist widths in a single design, and one that is designed such that the adjoining rafter does not require a birdsmouth cut.

The above and other objects, which will be apparent to those skilled in the art, are achieved in the present invention which is directed to a multi-heel connector for connecting structural members in building roof structures, comprising: a loop portion for securing a joist to a rafter, the loop portion having a top surface and two side surfaces forming a cross-section at least as large as a cross-section of the joist such that the joist may be slidably placed within the loop section, the loop section including through-holes for fasteners for securing the joist to rafter; an angled base segment adjacent to one side of the loop portion, the angled base segment having a top surface for receiving a rafter, the top surface angled at a predetermined roof pitch; at least two vertical mounting tabs, one vertical mounting tab located adjacent the angled base segment, another vertical mounting tab located adjacent the loop portion on a side opposite the angled base segment; and a horizontal base platform section adjacent each vertical mounting tab, the base platform and tabs section having through-holes for fasteners for securing the multi-heel connector to a top wall plate.

The loop portion, the angled base segment, the vertical mounting tabs, and the base platform sections may be integrally formed into one connector, and may be formed from a single sheet of gage steel or other metal.

The loop portion sidewall adjacent the angled base segment is preferably terminated at the angled base top surface, and the loop portion sidewall opposite the angled base segment is preferably terminated at the top wall plate.

The multi-heel connector may further include at least one blocking tab for securing a blocking member adjacent the joist and rafter, wherein the blocking tab is adjacent the horizontal base platform section, the blocking tab including through-holes for fasteners to secure the blocking member.

The multi-heel connector may include a tie down tab extending from the loop portion, the tie down tab opposite the vertical mounting tabs and extending to or beyond the top wall plate. The tie down tab can extend to an exterior wall stud, and preferably comprises a material that when secured to the top wall plate, the end of the joist, and the side of the rafter, is sufficient to withstand hurricane force loads. It may also include a tab for securing to the rafter.

The fasteners traverse the through-holes to secure the structural members, and may comprise screws, nails or bolts.

The multi-heel connector may further include a riser key for mating with the angled base segment, the riser key adjusting the roof pitch for the rafter.

Additionally, the multi-heel connector may include a joist spacer for placement within the loop portion, the joist spacer decreasing the loop portion cross-section to accommodate a joist having a cross-section smaller than the loop portion cross-section.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-9 of the drawings in which like numerals refer to like features of the invention.

The present invention addresses the roof-to-wall heel connection in modern housing construction. It does this by combining in one bracket a connector that restrains from movement structural members exposed to vertical, horizontal, and diagonal dead and live loads, including loads originating from hurricane force winds.

Figure 1:
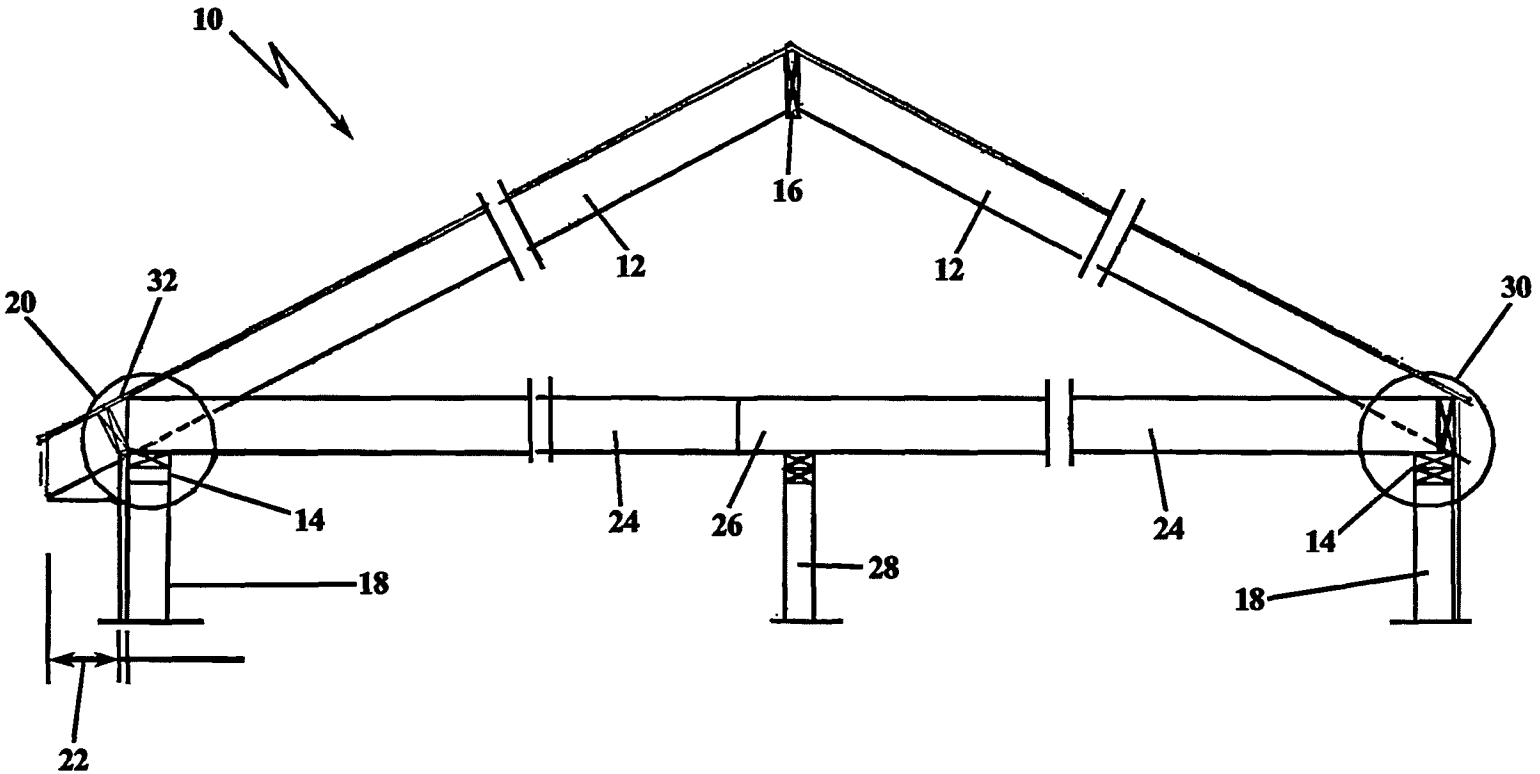
FIG. 1 depicts two conventional roof framing designs 10 in one construction.

FIG. 1 depicts two conventional roof framing designs 10 in one construction, provided here for exemplary purposes. Other roof framing designs may be accommodated by the multi-heel connector of the present invention. The left side of FIG. 1 depicts an overhanging roof design 20, where rafters 12 extend beyond the exterior stud wall 18 by an arbitrary, predetermined distance 22. The right side of FIG. 1 depicts a flush mounted roof design 30, where rafters 12 do not extend beyond the exterior stud wall 18. Normally, either one design or the other would be used for a single construction, the combination of the two simultaneously in a single structure is also possible.

In either roof framing design 20 or 30, rafters 12 extend at an angle from a top wall plate 14, shown here as a double plate, and are connected at an opposite end by a ridge board or beam 16. Top wall plate 14 is generally supported by the studs of exterior stud wall 18. Joists 24 extend horizontally from top wall plate 14. Joist 24 may overlaps and be extended by a joist or tie 26 if more length is required. Joist 24 may further be supported by an interior partition 28 if such support is needed. At each rafter-joist-exterior stud wall junction, blocking 32 is typically attached. The blocking 32 is supported approximately perpendicular to the angled rafter 12, and is secured between each rafter.

The multi-heel connector of the present invention is designed to attach rafter 12, joist 24, blocking 32, and exterior stud wall 18 in a single construction design. The multi-heel connector is preferably fabricated from a flat section of gage metal steel, or other solid, bendable material resilient enough to attach the structural members for building construction, and to withstand enhanced load forces. The attachment scheme to the structural members is preferably achieved by employing fasteners, such as screws, nails, and the like, through punch holes in the multi-heel connector plate.

The joint at the intersection of the roof rafter, joist, tie, blocking, wall plate, and wall studs is commonly referred to as the heel joint, where the multi-heel connector of the present invention is to be applied. The heel joint with all its individual structural members coming together forms one of the most significant joints in the entire building structure. It represents a point where the roofs dead and live loads are combined with wind and hurricane loads, exposing the heel joint to up lift and overturning forces in all directions. It is at this junction that the aforementioned loads are transferred to the exterior supporting bracing and shear walls.

Each structural member adjoining at the heel joint support particular superimposed loads which are combined at the multi-heel connector.

The description of an embodiment set out below to enable one to build and use an implementation of the invention is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 2:
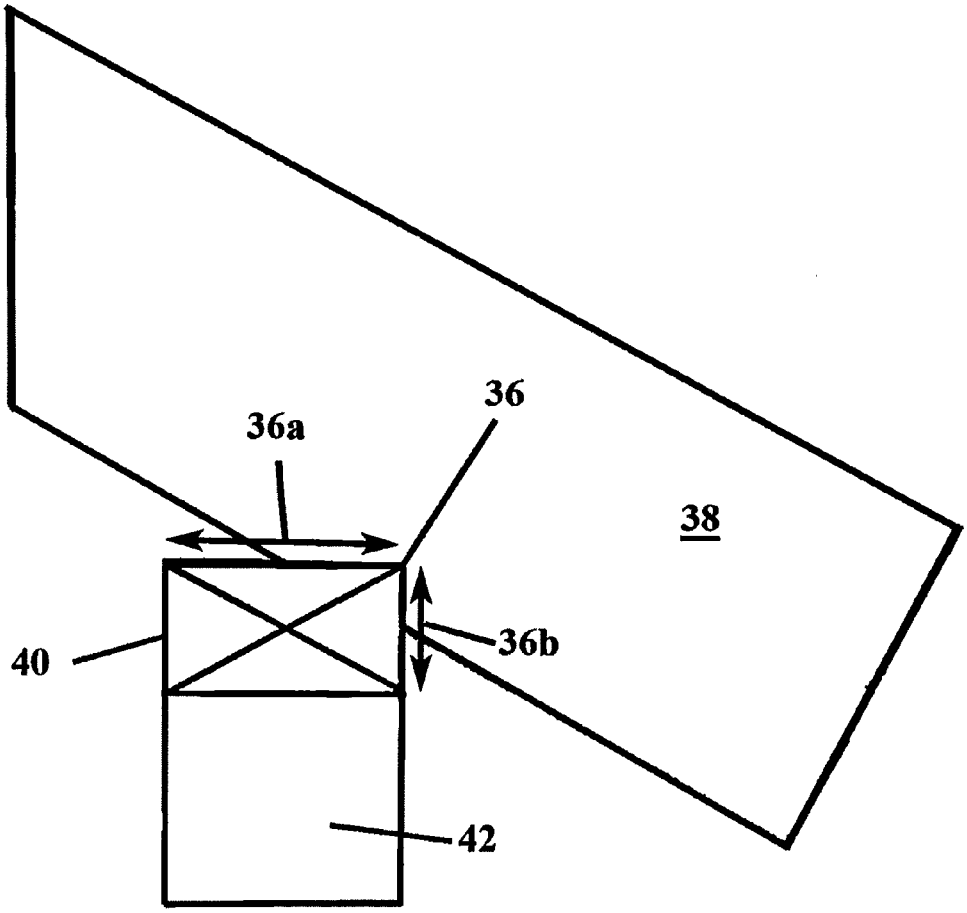
FIG. 2 (Prior Art)
FIG. 2 depicts a typical birdsmouth cut or seat in a rafter of the prior art.

One aspect of the multi-heel connector of the present invention is to eliminate the common birdsmouth cut or seat on rafters. A birdsmouth cut is essentially a notch in the rafter to allow the angled rafter to mate securely with the top wall plate. FIG. 2 depicts a typical prior art birdsmouth cut or seat 36 in a rafter 38. The birdsmouth cut 36 is an L-shaped notch with a horizontal component 36*a* and a vertical component 36*b* sized to fit on top wall plate 40, which is supported by the exterior wall stud 42. By virtue of the birdsmouth cut, the angled rafter has significantly more than a linear contact with the top wall plate. The surface area of weight-bearing contact (the horizontal component of the birdsmouth cut) is extended by the birdsmouth cut. Advantageously, the present invention omits the step of forming a birdsmouth cut, but provides the same, or greater, surface area of weight-bearing contact for the rafter.

The rafter contact surface on the multi-heel connector of the present invention is designed to have a slope which provides for the selected, predetermined roof pitch. This weight-bearing rafter is supported on the sloped surface of angled base segment 56, and the load is transferred to the vertical legs on each side of the connector, in which one side bears directly on the wall plate, and the other side is supported on the top of the joist, thus providing a contact surface on the multi-heel connector for receiving the rafter and providing considerably much more contact surface area than the birdsmouth cut mating surface or seat. This reduces the pressure on the top wall plate. In this manner, the weight-bearing surface area is centered over the top wall plate, eliminating the eccentric load on the stud typically caused by a conventional birdsmouth cut on the rafter.

The multi-heel connector allows for direct fastening between the rafter and the joist, and the angled rafter contact surface transfers the rafter thrust force to the joist. Both the rafter and the joist are secured via the multi-heel connector to one another.

Figure 3:
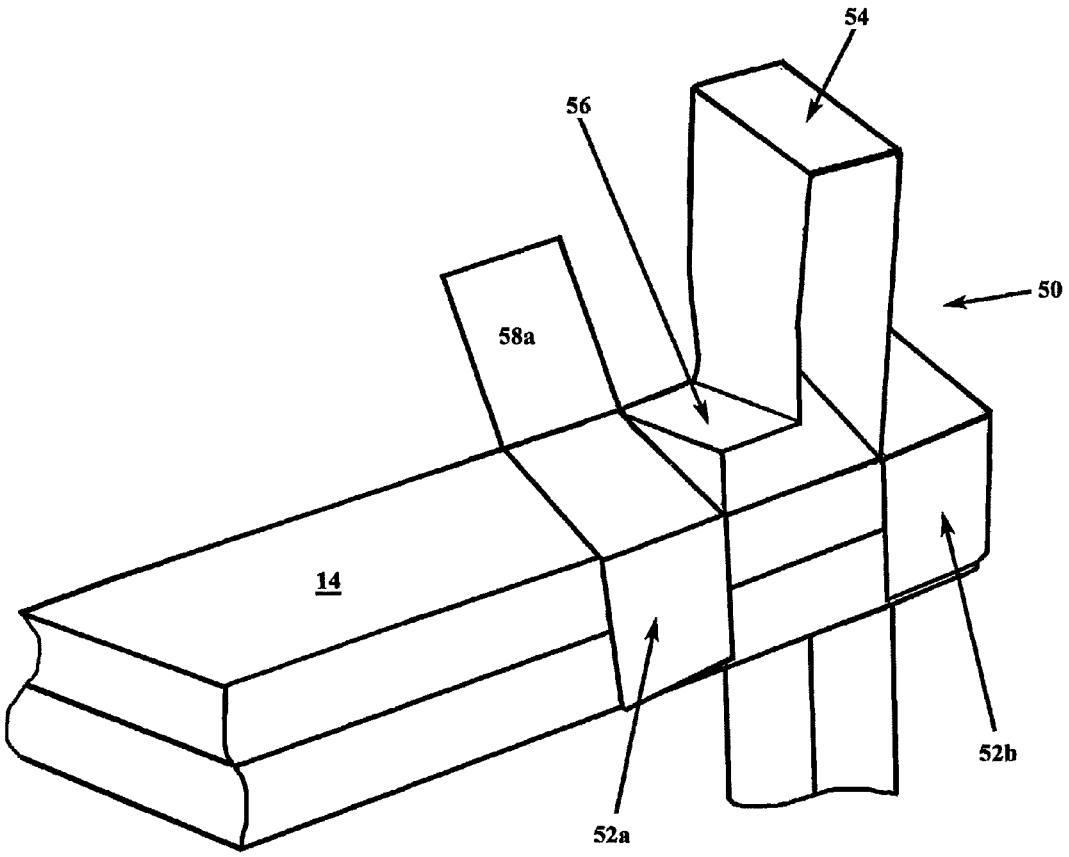
FIG. 3 depicts a side perspective view of a multi-heel connector of the present invention.

FIG. 3 depicts a side perspective view of a multi-heel connector 50 of the present invention. A loop portion 54 is shaped to receive a joist in a cross-sectional manner. Two vertical mounting legs 52*a,b* are provided to secure multi-heel connector 50 to top wall plate 14. These legs have a length adequate to secure multi-heel connector 50 and each portion of a double top wall plate together, which effectively reduces the number of wrapping ties otherwise used for stabilizing the top wall plate. Any uplifting forces are mitigated by the attachment of mounting legs 52*a,b* to top wall plate 14. Between loop portion 54 and one of the mounting legs 52*a* and extending from loop portion 54 at one end is an angled base segment or structure 56 that provides an angled rafter contact surface platform for the rafter to rest upon in its assembled, secured position.

Opposite the mounting legs 52*a,b* are angled blocking tabs 58*a,b* respectively. Blocking tabs 58*a,b* are provided to secure blocking members between each joist and rafter. These blocking members provide a uniform distribution of the shear load from roof sheathing to the top of the wall plate, which is transferred to the building bracing wall system. This feature supports the lateral bracing of the building. It also eliminates wood splitting caused from the ubiquitous toe-nailing of the blocking to the top plate generally performed in the prior art. The blocking members may be attached to either side of blocking tabs 58*a,b*. The blocking tabs 58*a,b* may also be angled to allow for a roof overhang or a flush mount end.

Figure 4:
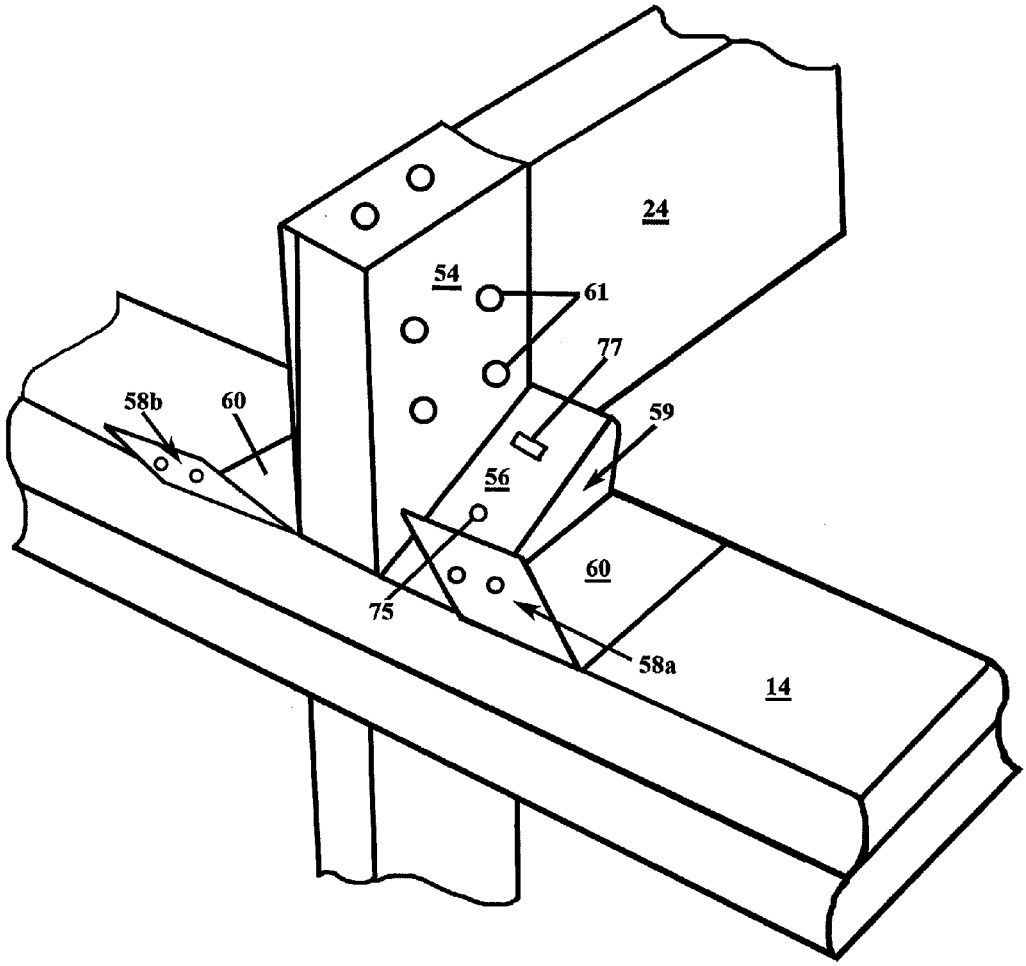
FIG. 4 depicts an alternate side perspective view of the multi-heel connector of FIG. 3 with the tie down tab removed.

FIG. 4 depicts an alternate side perspective view of multi-heel connector 50. A tie down portion, which normally extends from the top of loop portion 54 covering the exposed end of joist 24 and secured to top wall plate 14, is removed so that loop portion 54 can be readily seen. Angled base segment 56 is shown extending on one side from the bottom of loop portion 54 encompassing joist 24. On the other side of angled base segment 56 is side face 59, which is directed vertically downwards towards the base platform section 60 of multi-heel connector 50. Base platform section 60 bears directly on top wall plate 14 on each side of the rafter-joist combination. By fastening the rafter joist combination directly to the wall plate, inadvertent racking and horizontal movement is prevented. A plurality of fastener through-holes 61 are shown. The quantity and placement of these through-holes is design dependent, and the present invention is not limited to the number or location of through-hole placement. Care is taken to ensure that through-hole placement provides for maximum securing strength while minimizing the chance of wood splitting.

The shape of multi-heel connector 50 allows for direct fastening between the rafter and joist. The shape of the multi-heel connector 50 takes the horizontal force component of the attached rafter and transfers this force to structural components of the connector and into the joist through the connector.

Figure 5:
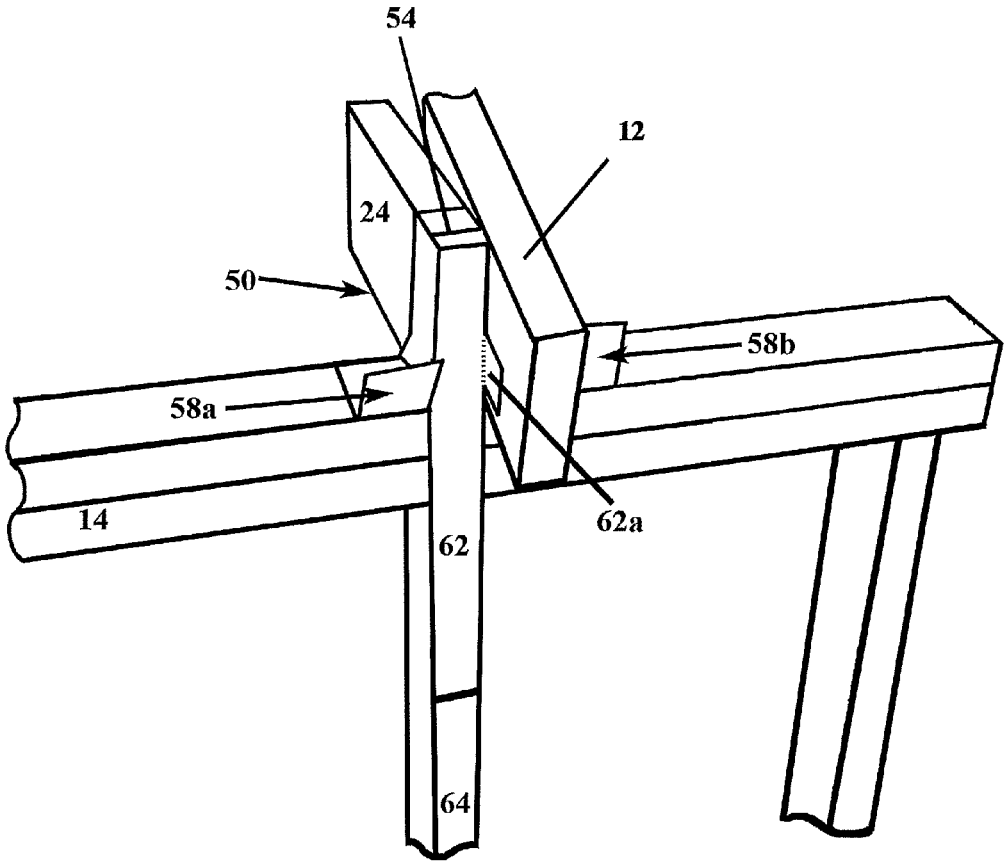
FIG. 5 depicts the multi-heel connector of FIG. 3 with a rafter and joist attached, and tie down tab.

FIG. 5 depicts multi-heel connector 50 of the present invention with a rafter 12 and joist 24 attached. Blocking members are removed to show the multi-heel connector more clearly. The rafter rests on the angled base segment shown in FIGS. 3 and 4. The angled base segment is angled relative to the wall plate, and runs at an angle that is less than the perpendicular. In this figure, the angled base segment is underneath rafter 12. Tie down tab 62 is depicted extending from the top of loop 54, beyond top wall plate 14, and extending to an exterior wall stud 64.

The fastening of tie down tab 62 resists upward forces from wind of even hurricane strength, and is made to be within building codes for such designs. Tie down tab 62 serves to anchor and fasten the entire roof system to the building shear wall, providing a stable structure under imposed loads. By extending tie down tab 62 over the wall sheathing, the roof system is assured greater attachment strength than the current prior art designs. Tie down tab 62 preferably includes a tab 62*a* to secure the rafter.

Figure 6:
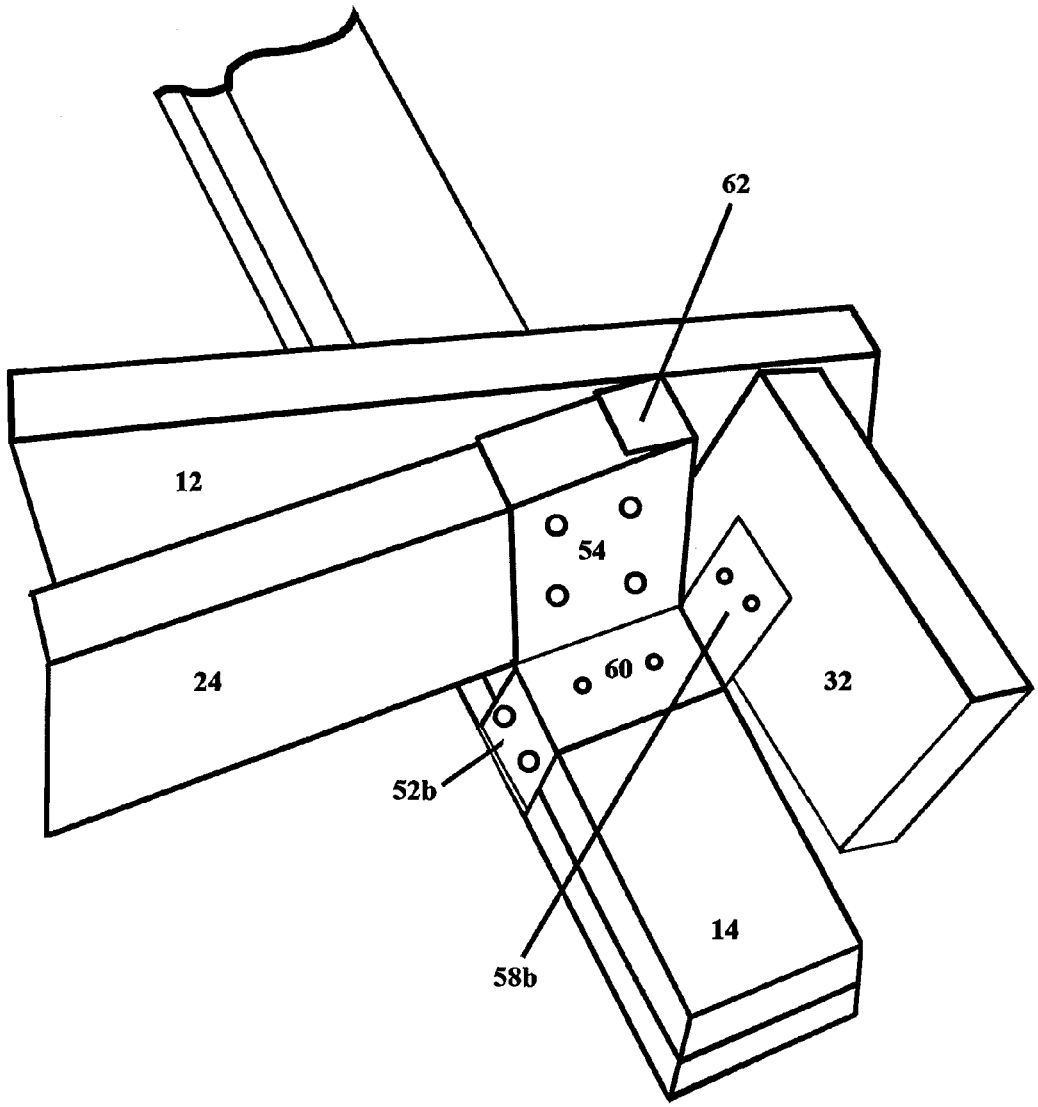
FIG. 6 depicts a perspective view of the multi-heel connector of FIG. 5 with a blocking member attached to one of the blocking tabs.

FIG. 6 depicts a perspective view of the multi-heel connector 50 of FIG. 5 with blocking 32 attached to one of the blocking tabs 58*b*. This figure demonstrates how blocking tabs 58 may be utilized in one embodiment to secure blocking members between joists and to top of wall plate 14. The top portion of tie down tab 62 is shown separate and distinct from loop portion 54. Tie down tab 62 may be a separate attachment to multi-heel connector 50, or may be integral with it. Integration of the tie down tab may facilitate manufacturing of the multi-heel connector from a single sheet of gage steel, or the like. The tie down tab 62, if fabricated separately, may be a stronger, heavier gage to accommodate more robust upwardly directed loads. Furthermore, the tie down tab 62 may be placed directly to a stud or over sheathing.

Figure 8A:
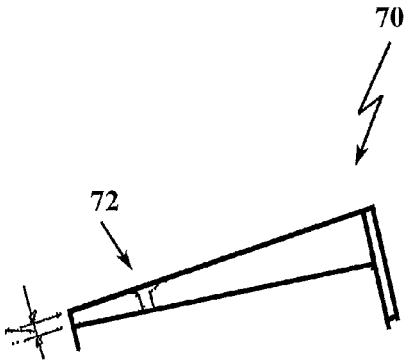
FIG. 8A depicts a side view of an exemplary riser key for the multi-heel connector.
Figure 8B:
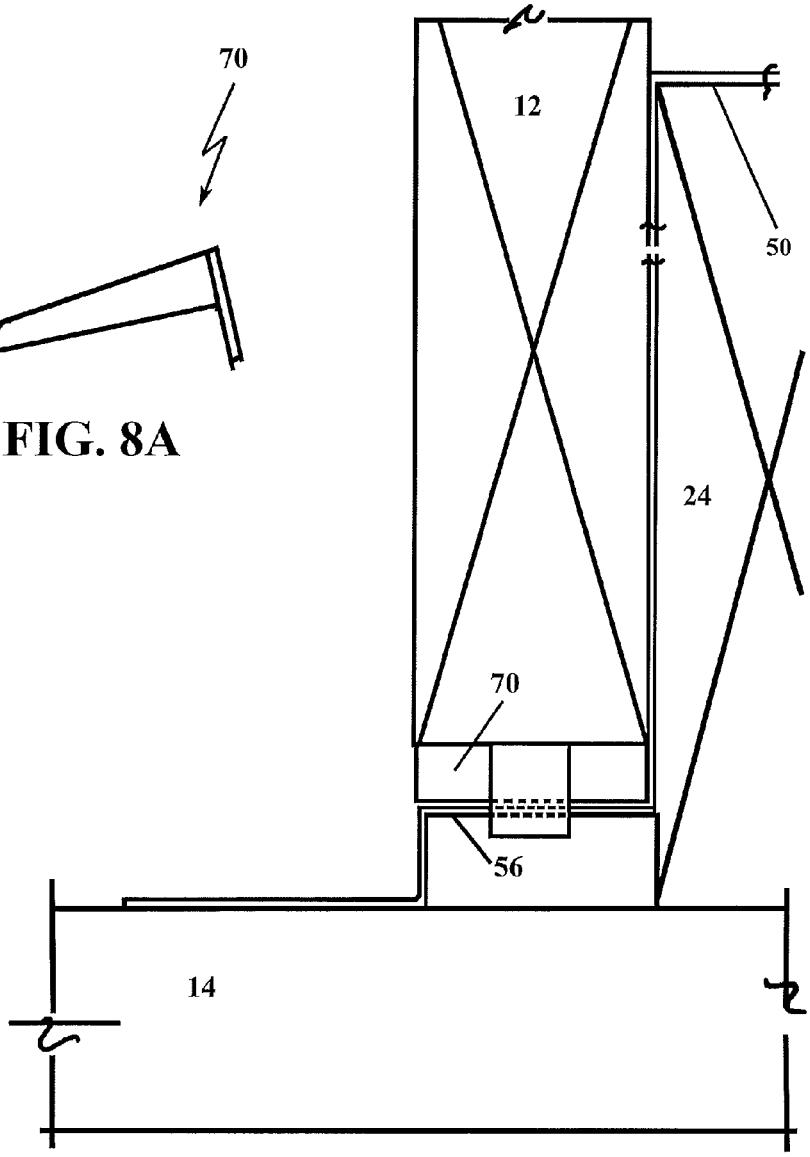
FIG. 8B depicts the multi-heel connector with a riser key in place on the angled base segment to alter the pitch of rafter.

Each multi-heel connector may be fabricated of a single angle base structure for a desired, predetermined rafter placement angle, or can be fabricated into a low rise setting that accommodates the placement and attachment of a separate riser increment or riser key to make a preferred roof pitch. The riser key may be a separately fabricated angled block, such as a triangular attachment, that adjusts the angle of the roof pitch. FIG. 8A depicts a side view of an exemplary riser key 70 for the multi-heel connector. Riser key 70 shown as a ramping, or angled structure which is fabricated to be placed upon angled base segment 56 and alter the pitch surface for the rafter 12. Riser key 70 may fabricated and selected for a predetermined pitch angle, or may be an adjustable attachment to the angled base segment 56, capable of a plurality of pitch angles. Riser key 70 may be attached to angled base segment 56 by a fastener 72, such as a screw, although riser key 70 is not limited to any particular type of fastener, and other fastening means may be employed. FIG. 8B depicts the multi-heel connector 50 with a riser key 70 in place on the angled base segment 56 to alter the pitch of rafter 12. As depicted in FIG. 4, the angled base segment 56 includes a through-hole 75 and/or an aperture 77 to receive and secure riser 70. More than one riser key 70 may be implemented simultaneously, for example by stacking, to achieve a sharp roof pitch design. Riser key 70 may be a one-piece construction from a bendable steel gage sheet, or may be constructed from multiple components secured together to form a surface area which is appropriately angled to receive the rafter, or may be constructed from a solid cast piece.

Figure 7:
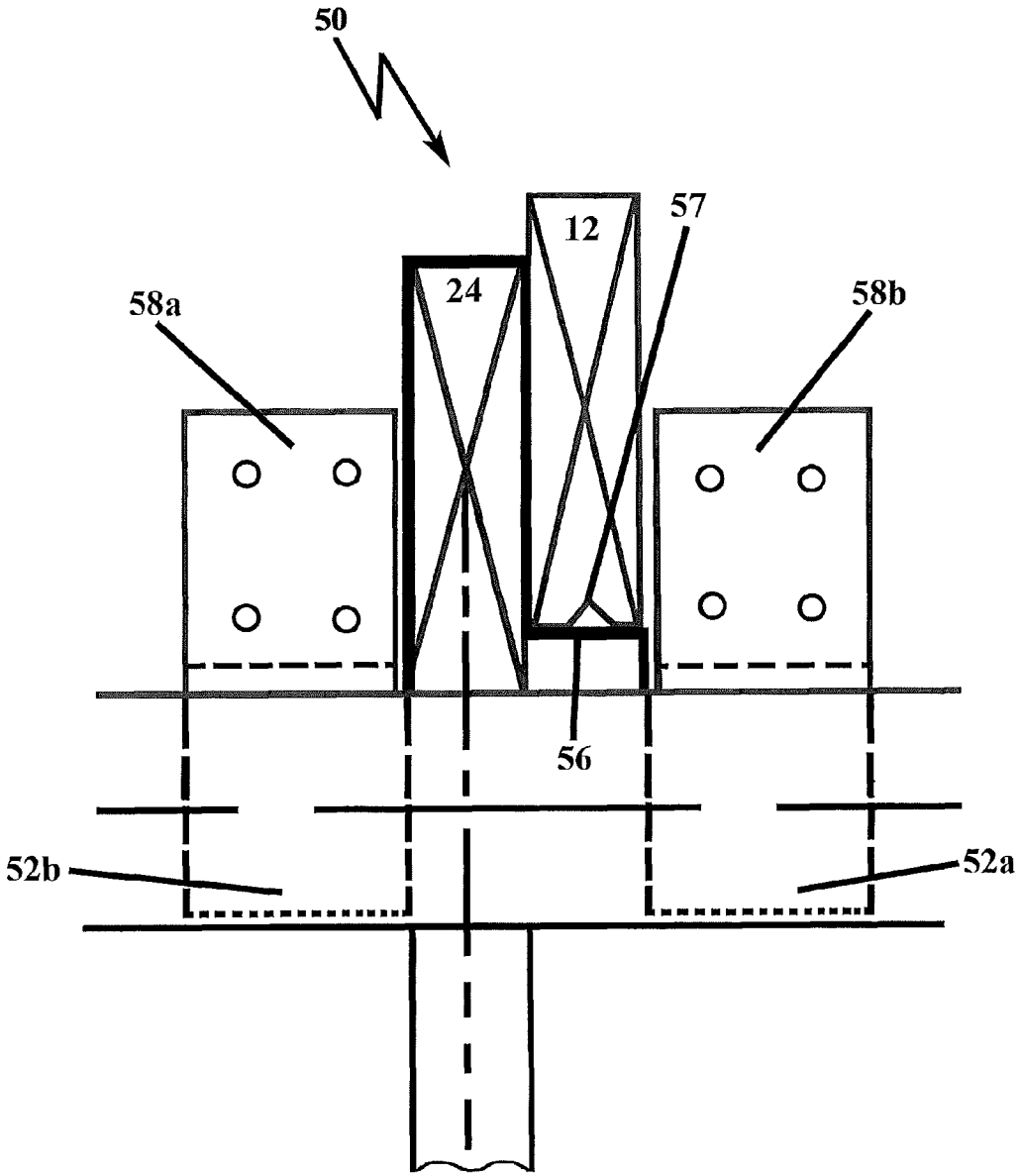
FIG. 7 is view of the multi-heel connector depicting the faces of blocking tabs 58*a,b;*

FIG. 7 is view of the multi-heel connector 50 depicting the faces of blocking tabs 58*a,b*. Rafter 12 is attached to joist 24 through the bracket. In at least one embodiment, the angled base segment 56 has a sharp metal nipple 57 for piercing the rafter and holding it in place while the rafter is fastened to the joist through the multi-heel connector.

FIG. 6 base platform sections 60 may be sized for different top wall plate construction, such as 3½ inch or 5½ inch wide to accommodate 2"×4" or 2"×6" construction. Alternatively, the multi-heel connector's base platform sections 60 may be the smaller dimension with the vertical tab extended an additional length with a fold line to allow for larger dimension utility in a single package.

Similarly, the vertical mounting legs 54 on each side of the joist may be fabricated either for 5½ or 7½ inch lengths to accommodate 2"×6" or 2"×8" joists. Alternatively, the multi-heel connector's vertical mounting legs may be the larger dimension with an additional, separate joist spacer that would adjust for a 2"×6" joist.

Figure 9:
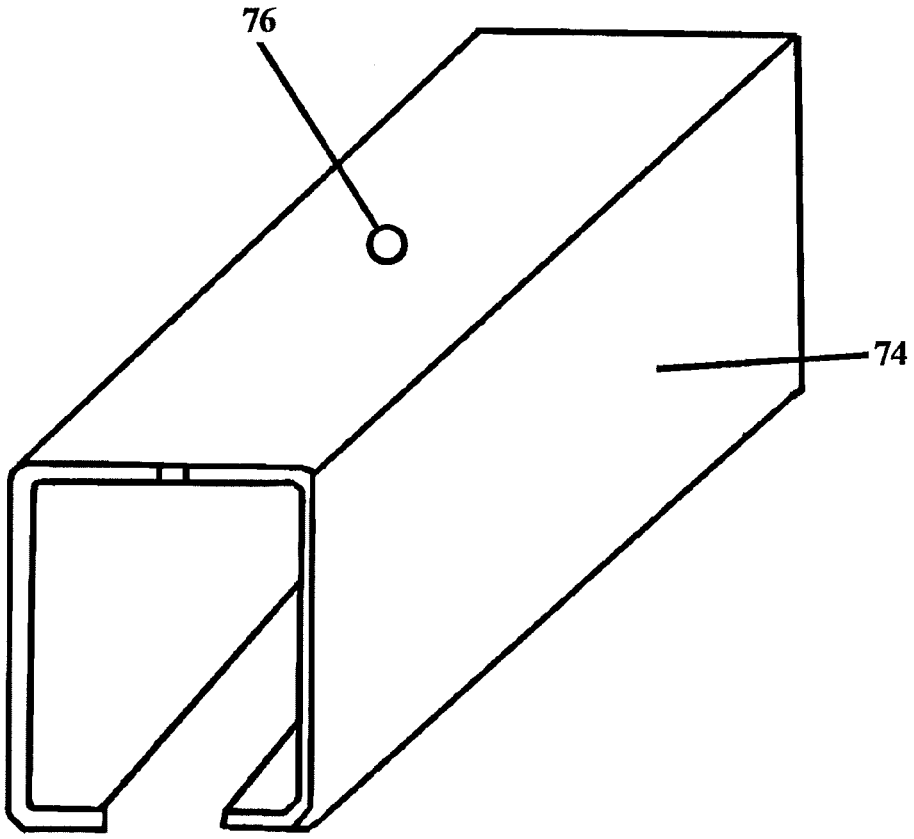
FIG. 9 depicts one embodiment of a joist spacer for insertion within the loop portion of the multi-heel connector.

FIG. 9 depicts a joist spacer 74 for insertion within loop portion 54 of the multi-heel connector. Joist spacer 74 serves to allow the multi-heel connector to have a single size loop portion and still allow for a smaller joist dimension. In this manner, for example, the multi-heel connector may accommodate 2"×6" joists as well as 2"×8" joists. In a preferred embodiment, joist spacer 74 is shown as a partially rectangular, hollow form, and is fabricated to fit within loop portion 54, filling the gap between loop portion 54 and the inserted, smaller joist. Joist spacer 74 may be fabricated from a single, bendable steel gage sheet or other like material. Joist spacer 74 may also be a solid piece construction, and need not be completely rectangular in cross-section. It is desirable for joist spacer 74 to have sufficient height between the joist and the interior wall of the loop portion 54. A through-hole 76 is depicted in joist spacer 74 as an exemplary attachment means to loop portion 54 and joist; however, joist spacer 74 is not limited to any particular type of fastener, and other fastening means may be employed.

The present invention is adaptable to accommodate various sizes of rafters, joists, wall plates, studs, and sheathing, and is not limited to any particular dimensions for these structural components. The multi-heel connector is designed to provide a direct load path transfer through each structural member.

Preferably, the fabrication of the multi-heel connector of the present invention is simplified by constructing it from a single sheet of light gage metal, although the multi-heel connector may also be formed of separate components that are attachable in a structurally sound manner that ultimately performs the function of the multi-heel connector as claimed.

It is further noted that the tabs used for blocking members and the vertical mounting legs may be located on opposite sides of the multi-heel connector as currently shown in the figures.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A multi-heel connector for connecting structural members in building roof structures, comprising:

a loop portion for securing a joist to a rafter, said loop portion having a top surface and two side surfaces forming a cross-section at least as large as a cross-section of said joist such that said joist may be slidably placed within said loop portion, said loop portion including through-holes for fasteners for securing said joist to said rafter through said loop portion;

an angled base segment adjacent to one side of said loop portion, said angled base segment having a top surface for receiving said rafter, said top surface angled at a predetermined roof pitch;

at least one vertical mounting tab attached to or integral with said loop portion or said angled base section or both;

a horizontal base platform section adjacent said at least one vertical mounting tab, said base platform section having through-holes for fasteners for securing said multi-heel connector to a top wall plate; and at least one blocking tab for securing a blocking member adjacent said joist, wherein said blocking tab is adjacent said horizontal base platform section, said blocking tab including through-holes for fasteners to secure said blocking member between said joist, and to a wall plate.

2. The multi-heel connector of claim 1 wherein said loop portion, said angled base segment, said at least one vertical mounting tab, said horizontal base platform section, and said at least one blocking tab are integrally formed into one connector.

3. The multi-heel connector of claim 2 wherein said loop portion, said angled base segment, said at least one vertical mounting tab, said horizontal base platform section, and said at least one blocking tab are formed from a single sheet of gage steel.

4. The multi-heel connector of claim 1 wherein said loop portion includes a sidewall adjacent said angled base segment and a sidewall opposite said angled base segment, said loop portion sidewall adjacent said angled base segment terminates at said angled base top surface, and said loop portion sidewall opposite said angled base segment terminates at said horizontal base platform section.

5. The multi-heel connector of claim 1 including at least one tie down tab adjacent said loop portion, said at least one tie down tab extending to or beyond said top wall plate.

6. The multi-heel connector of claim 5 wherein said at least one tie down tab extends to an exterior wall stud to provide tie down capability.

7. The multi-heel connector of claim 5 wherein said at least one tie down tab comprises a material that when secured to said top wall plate and stud is sufficient to withstand hurricane force loads.

8. The multi-heel connector of claim 5 wherein said at least one tie down tab includes a horizontal tab component for securing to said rafter.

9. The multi-heel connector of claim 1 wherein said fasteners traverse said through-holes to secure said structural members, said fasteners including screws, nails, or bolts.

10. A connector for connecting structural members in building roof structures, comprising:

a loop portion for securing a joist to a rafter, said loop portion having a top surface and two side surfaces forming a cross-section at least as large as a cross-section of said joist such that said joist may be slidably placed within said loop portion, said loop portion including through-holes for fasteners to secure said joist to rafter;

an angled base segment adjacent to one side of said loop portion, said angled base segment having a top surface for receiving said rafter, said top surface angled at a predetermined roof pitch;

at least one vertical mounting tab extending vertically downwards from a horizontal base platform section;

said horizontal base platform section adjacent said at least one vertical mounting tab, said horizontal base platform section having through-holes for fasteners for securing said connector to a top wall plate;

at least one blocking tab for securing a blocking member adjacent said joist, wherein said blocking tab is adjacent said horizontal base platform section, said blocking tab including through-holes for fasteners to secure said blocking member; and a tie down tab adjacent said loop portion, said tie down tab extending to or beyond said top wall plate;

wherein said loop portion sidewall adjacent said angled base segment terminates at said angled base top surface, and said loop portion sidewall opposite said angled base segment terminates at said top wall plate.

11. The connector of claim 10 wherein said tie down tab extends to an exterior wall stud.

12. The connector of claim 10 wherein said tie down tab comprises a material that when secured to said top wall plate, joist, or rafter, or any combination thereof, is sufficient to withstand hurricane force loads.

13. The connector of claim 10 wherein said fasteners traverse said through-holes to secure said structural members, said fasteners including screws, nails, or bolts.

14. The connector of claim 10 including a riser key for mating with said angled base segment, said riser key adjusting roof pitch for an angle different than said predetermined roof pitch of said angled base segment for said rafter placement.

15. The connector of claim 10 wherein said at least one vertical mounting tab includes through-holes for fastening said connector to said top wall plate.

* * * * *